United States Patent [19]

Hilger et al.

[11] Patent Number: 4,645,878

[45] Date of Patent: Feb. 24, 1987

[54] ARRANGEMENT FOR HOLDING, ACCOMMODATING, INSTALLING AND CONNECTING ELECTRICAL APPARATUS FOR A CONFERENCE TABLE

[75] Inventors: Wilfried Hilger, Wiesbaden; Oscar Müller, Massenbachhausen, both of Fed. Rep. of Germany

[73] Assignee: August Froscher GmbH & Co. K.G., Baden-Wurttemberg, Fed. Rep. of Germany

[21] Appl. No.: 697,137

[22] Filed: Feb. 1, 1985

[30] Foreign Application Priority Data

Feb. 1, 1984 [DE] Fed. Rep. of Germany ..... 3403345

[51] Int. Cl.[4] ..... H04M 3/56

[52] U.S. Cl. ..... 379/202; 108/64; 312/223

[58] Field of Search ..... 108/64, 25; 179/18 BC; 312/21, 194, 195, 291, 223; D6/480, 454

[56] References Cited

U.S. PATENT DOCUMENTS

| | | | |
|---|---|---|---|
| 2,493,170 | 1/1950 | Stiff et al. | 108/64 X |
| 3,694,578 | 9/1970 | Reid | 179/18 BC |
| 3,915,100 | 10/1975 | Sullivan | 108/64 |
| 4,163,867 | 6/1977 | Breidenbach | 714/48 |
| 4,400,724 | 6/1981 | Fields | 358/85 |
| 4,511,198 | 4/1985 | Mitchell et al. | 339/34 |

FOREIGN PATENT DOCUMENTS

| | | |
|---|---|---|
| 1980884 | 3/1968 | Fed. Rep. of Germany . |
| 2009596 | 9/1970 | Fed. Rep. of Germany . |
| 2525498 | 12/1976 | Fed. Rep. of Germany . |

OTHER PUBLICATIONS

"A Communication System for Remote Conference", Trueman, Systems Technology, Jun. 1976, No. 24, pp. 17–21.

*Primary Examiner*—Gene Z. Rubinson
*Assistant Examiner*—R. Vaas
*Attorney, Agent, or Firm*—Robert E. Burns; Emmanuel J. Lobato; Bruce L. Adams

[57] ABSTRACT

A conference table assembly comprises a plurality of conference tables each having a top providing a writing surface for a user, and a plurality of accessory units sandwiched between adjacent tables. Each of the accessory units has a top which is the same thickness as the conference table tops and is supported flush with them. In the accessory unit top there is an opening into a trough-like housing which is divided into compartments housing electrical and electronic components. The opening is closed by a removable panel on which are mounted such components as a goose neck lamp, microphone, keyboard, control elements, indicating instruments, etc. Preferably an accessory unit is provided between two user positions so that it can serve both. Each accessory unit preferably has a leg and foot so that it is self supporting and is provided with quick-release fasteners for connecting it to the tables.

21 Claims, 12 Drawing Figures

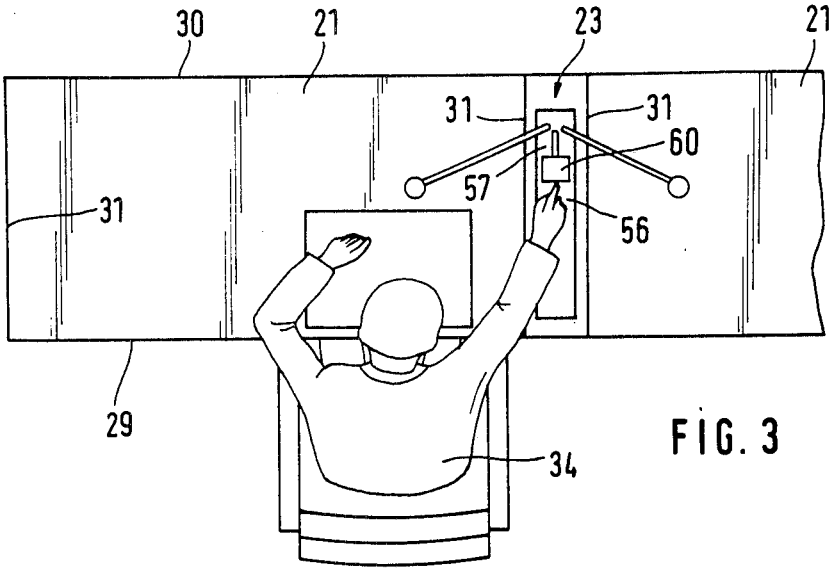
FIG. 3
FIG. 4
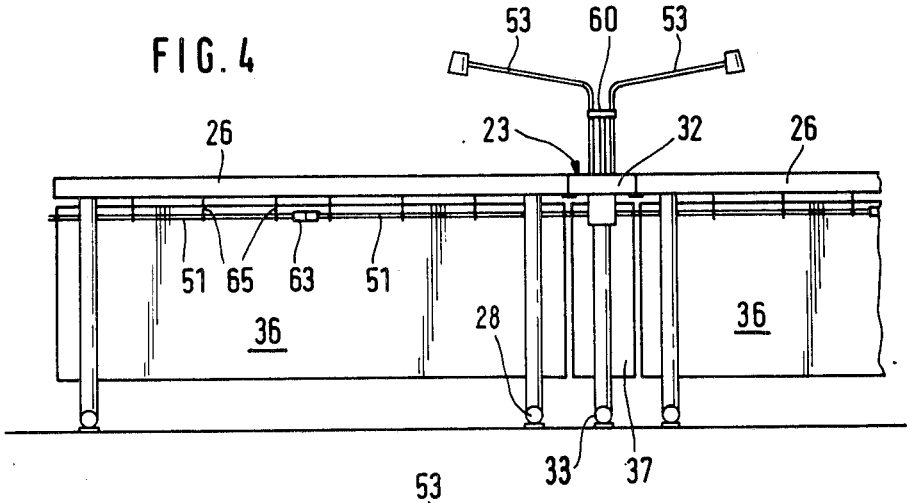
FIG. 5
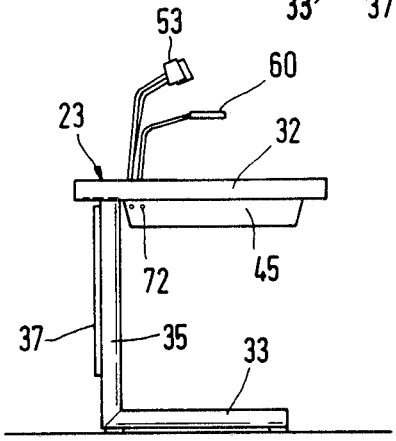

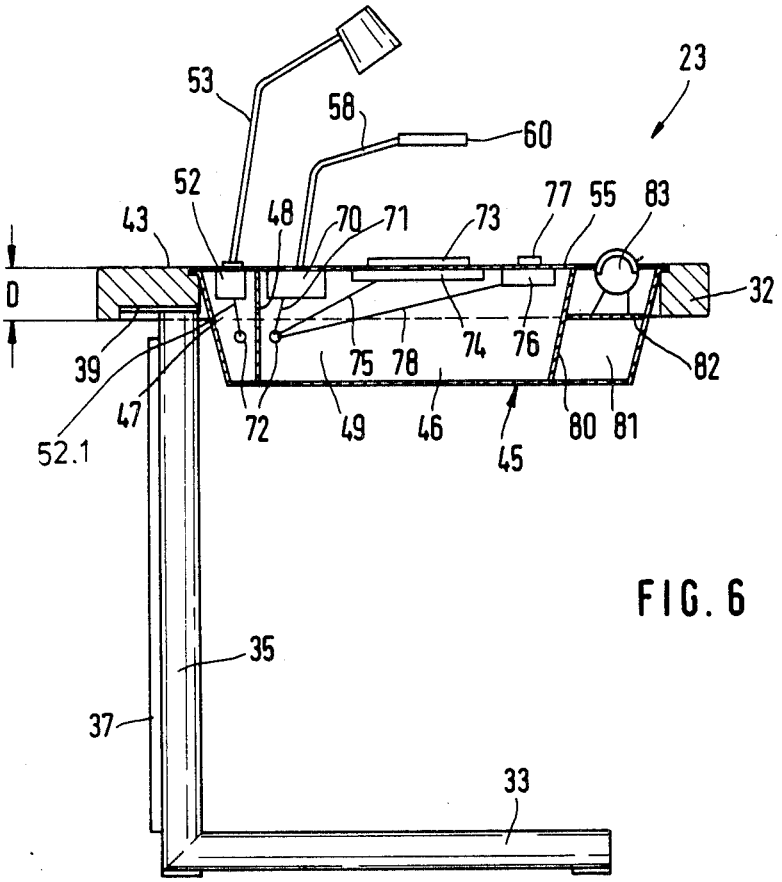
FIG. 6
FIG. 7
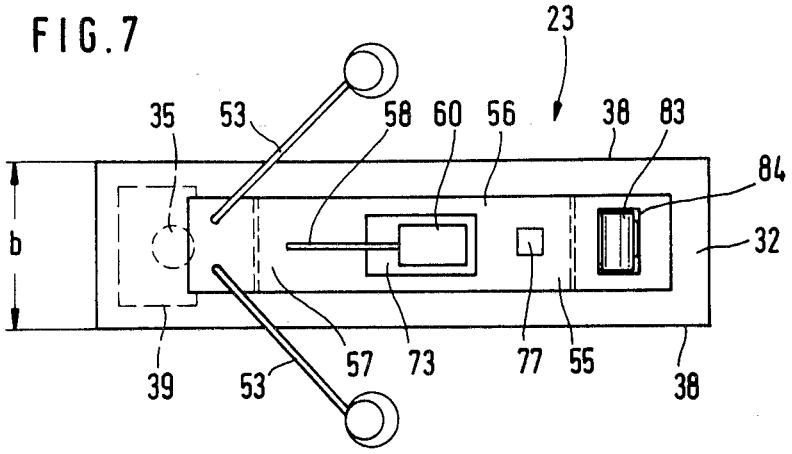

ARRANGEMENT FOR HOLDING, ACCOMMODATING, INSTALLING AND CONNECTING ELECTRICAL APPARATUS FOR A CONFERENCE TABLE

FIELD OF INVENTION

The invention relates to an arrangement for holding, accommodating, installing and connecting electrical apparatus for a conference table, with a cover on or in which a microphone holder, lights and/or control or indicating elements for electro-acoustic apparatus and/or remote control apparatus are mounted and at least one compartment for accommodating accessory elements such as amplifiers, transformers, control apparatus, connection plugs, etc.

BACKGROUND OF THE INVENTION

For conferences, much electrical and electronical equipment is needed and indeed among others, microphones, loudspeakers, desk lamps, telecommunication apparatus, etc., whereby the participants can announce decisions or transmit or receive information. The required apparatus and equipment is driven by intermediate or low voltage. The conductors are accordingly to be separately arranged and accommodated. The apparatusses and their parts are to be held, accommodated and connected. The many apparatusses and the like must be accessible and convenient for the user. They must, moreover, satisfy the electro-acoustical requirements. As different requirements must be met, the apparatusses have heretofore for the most part, been accommodated in different positions on the table. Occasionally, microphones in some cases combined with loudspeakers or lights, have been positioned on the table and control panels of electronic communication equipment have been arranged in another position. Insofar as these have been combined, corresponding housing has been provided on the longitudinal side of the table, opposite the participant as individual casings or as continuous channels whereby also conductors are accommodated in such channels.

In equipping normal worktables with electrical and electronic apparatus, the problem of accommodating the cables and plug-in connections is well known. Thereto there have been many proposals to lead the cables in hollow spaces in the frame parts or in separate cable channels, which are provided on the longitudinal side of the table or on the cross side in a cross beam, also so formed that covers on the table top can be taken away for connection and then brought back in position. Thus, according to DE-GM 19 80 884, there is provided in a writing table top a cutout which is closable by a cover and whereby on the underside of the table top there are provided carrier plates for plug sockets for supplying low voltage. Lead-out openings between the cover and the cutout allow bringing out the electrical connecting conductors. This arrangement is suitable only for a range of voltages and requires a cutout in the normal table top. For conference table installations, similar cutouts for passage of the cable have likewise been provided without their being described in publications. A similar arrangement of plug sockets in the sidewall of a writing table is known through DE-OS 25 25 498. The wall carrying these plug sockets extends to the table top height or above and is arranged on the shorter end side of the writing table. In the sidewall there are plug sockets which are accessible from above or from the side. Connection facilities are thereby provided in convenient reach without disturbing the working surface, however, without any apparatus or control elements.

From DE-OS 20 09 596 there is known a writing table of which two side regions adjacent the work surface proper have slidable plates over enclosures which are slidable crosswise to the longitudinal direction and under which there are provided compartments for electrical equipment and the like which are covered by sliding the plates back. The apparatus can thereby be available when required or can be covered. However, such an arrangement is unsuitable for a conference table.

The many proposals for providing electrical apparatus and conductors for a work table and writing table have heretofore had no suggestion for significant design for providing for electrical apparatus and conductors on a conference table installation. The requirements for a conference table are of a special nature. For one thing, there must be provided a wide variety of indicating and control devices, which correspond in number to the number of participant positions and are connected with one another and/or with a central control unit. Moreover, an intermediate voltage supply must be provided for lights and other intermediate voltage apparatus. Finally, ash trays, glass holders, and the like must be accommodated. For a conference table installation several flat tables are as a rule joined. These are occasionally also used for other purposes so that the electrical conference devices must be removed from the table and be annexed and connected as required. If the connecting conductors must then be inserted through openings in the table and connected, the different apparatus with the different voltage supplies and control devices, a considerable amount of work and time is required for the assembling and connecting.

SUMMARY OF THE INVENTION

The invention is directed to the problem of providing the apparatus needed by individual conference participants and to install or remove the apparatus quickly and to provide simple and safe connections without dealing with contacts on the table with the exception of terminal fastenings and the like.

In accordance with the invention there are provided alongside the conference table, accessory units which in essentially the same plane, are combinable with at least one conference table and which in an opening of the accessory table surface have selectively combinable input-output operating and control means of electro-acoustic equipment, remote control devices, remote information devices and/or lighting devices and which have plug-in connection means for conductors running beneath the conference table top and/or along a longitudinal edge of the conference table. Further in accordance with the invention, there is provided transverse to the user's side of the conference table, thus between conference tables in a corner of an angle arrangement or on an end, an accessory unit which accommodates all conference apparatus and the like, which carries cables and is connected only through a plug-in connection. Thus, the table surface remains fully free. Nothing needs be altered on the table. The tables can, as desired, be used as individual normal tables without a conference installation or as an electrical and electro-acoustically outfitted conference installation. This is important because the electronic conference installation represents valuable apparatus which should not be unnecessarily used and endangered by other use. Added on or inserted between the conference tables they enable the use of valuable electronic equipment which also with technical and electronic accessories enable an orderly and expeditious conference procedure and by which the valuable equipment is not damaged and thus assures outstanding transmission quality as is valuable for a good physical understanding as a prerequisite for pursuasion and opinion forming processes in the sense of learning theory. It has structural provisions, for example, for loudspeakers, cable technique and the like. The parts are compatible and are combinable with present and new tables according to need. They can be arranged ergonomically correctly and in like or opposite arrangement, can provide a head table and the like. Fast assembly and disassembly and constantly arranged accommodation of all necessary and related parts are assured.

The accessory units are preferably provided with an upwardly opening trough which is thus accessible from above and in which the apparatus can be inserted from above. This trough provides mechanical protection and moreover, an electrical shield whereby it consists of metal or can be produced from metalized plastic material and is conductively connected with the shielding or ground. Mounting and repair work are thus carried out not from below, but after removing the apparatus upwardly, on exposed apparatus. The trough can be divided into several compartments in order to provide separate electrical shielding for different components and to provide the different voltages according to the specifications. The accessory unit is advantageously formed with a panel fitting the table and preferably of like depth. It is thus inserted suitably in the table layout and the entire apparatus which, including control and indicating elements, is referred to as "E-apparatus" in the following description, are installed essentially flush. The table panels of the accessory units preferably have like or similar edge formation as the tables with which they are used. This leads not only to a pleasing appearance, but also contributes to avoiding injury and facilitating cleaning. Each accessory unit is advantageously connected with at least one table by a quick acting coupling. These can be selected from known couplings and are preferably disposed on the underside of the table. A fastening on one table is sufficient and above all is provided at the end. However, fastening elements can be provided on both of the adjacent tables.

The accessory unit can extend over only a part of the height of the conference table and is then held by at least one of the adjacent tables. Thus, it need be, only a relatively shallow element which is hung laterally on one table, or between two tables. However, an advantageous design is that the accessory unit is formed with a foot of its own. It is then a complete small table which, above all on assembly, can be favorably positioned adjacent and secured to a table. The foot can, if necessary, be adjustable heightwise in order to be used with tables of different height. The feet advantageously correspond in style and arrangement with those of the remaining conference tables. The connection with the conference tables can be effected directly. However, it can also be effected in corner regions by adapter elements or bellows extensions. Thus intermediate elements for the corner regions or a U-form arrangement or the like can be produced as standard elements, so that individual elements need not be custom made. The accessory units will in this instance have two parallel side edges and be arranged between the conference table. In order to simplify the connection, the accessory units and the conference tables are preferably provided with matching elements for the aligned connection of the same with one another.

As a rule, the E-apparatus occupies only a part of the table surface of the accessory unit. The rest is filled up by the selected panel of suitable form. However, the E-apparatus and/or the trough opening can be formed so that they take up the entire upper surface of the accessory unit up to the table edge. Then there is no table top as such and the trough or a framing takes over the main supporting function. Such accessory units can favorably be used for simple tables and/or with very many flush mounted instruments without matching the respective table model.

For convenience of production and repair, the E-apparatus and its indicating and control elements of each accessory unit are advantageously mounted on a single panel which in a substantially plane surface, covers the opening of the accessory table surface. Thereby, the control and indicating elements are on the upper side of the panel, while the electrical and electronic supply and processing devices, the cable and the load devices and the like are on the underside. Thus the panel with all electrotechnical devices can be completed in an electro-technical plant while the remaining assembly can be carried out in a furniture plant. If necessary, plug-in swinging arms or goose neck lamps and microphones can be installed later. Thus a very rational design is attained.

The accessory units may be provided with duplicate E-apparatusses such as lights, switches, plugs and the like, so that a unit can be arranged between two conference positions and provides each participant with favorable lights and switches. The reading devices for information carriers, display screens, and other information receivers and/or information transmitting and receiving devices such as keyboards, viewing screens and the like, need be provided only once in each accessory unit for two neighboring tables because the signals or input keyboards can be correspondingly designed, thus the number of the required switching and control means for this purpose can be reduced by half.

The accessory units with their E-apparatusses can advantageously be connected with one another or with a central control unit by a one-cable conductor. This conducting cable advantageously leads laterally out of the accessory units. They can be easily manipulated and plugged in. For this purpose, the one-cable connections are provided with diversified plugs for the non-interchangable plug connections of the associated apparatus and the plugs preferably lie in the middle under the conference table. It is thus necessary to make only one plug connection. The holding devices for the cable are preferably laterally opening cable canals or adhesive clamps which are provided under the table top or along the table top and are easy to operate.

In the cover for the opening of the accessory table top, there can be provided openings for an ashtray and/or glass and/or small drinking flask under which there are provided supporting surfaces of proper height in the trough and/or on the accessory unit.

The accessory unit designed as the operation or control unit for the entire conference installation, has in its table top opening electrical and electronic apparatus different from other accessory units, in particular receiving devices for the evaluation of selections, for the allocation of speech and central amplifier are if necessary arranged under, preferably demountable and closable covers. Further particulars and developments of the invention will appear from the following description in conjunction with the accompanying drawings.

BRIEF DESCRIPTION OF DRAWINGS

Preferred embodiments of the invention are illustrated in the accompanying drawings in which:

FIG. 3 is a schematic plan of three conference positions between two of which an accessory unit is provided.

FIG. 4 is an elevation of the arrangement of FIG. 3 from the side of the seat position but without the chair and participant.

FIG. 5 is a schematic end view on the same scale.

FIG. 6 is an enlarged end view partially in section with a schematic indication of detachable accessories.

FIG. 7 is a plan of the schematic arrangement of the accessory unit according to FIG. 6.

DESCRIPTION OF PREFERRED EMBODIMENTS

Figure 1:
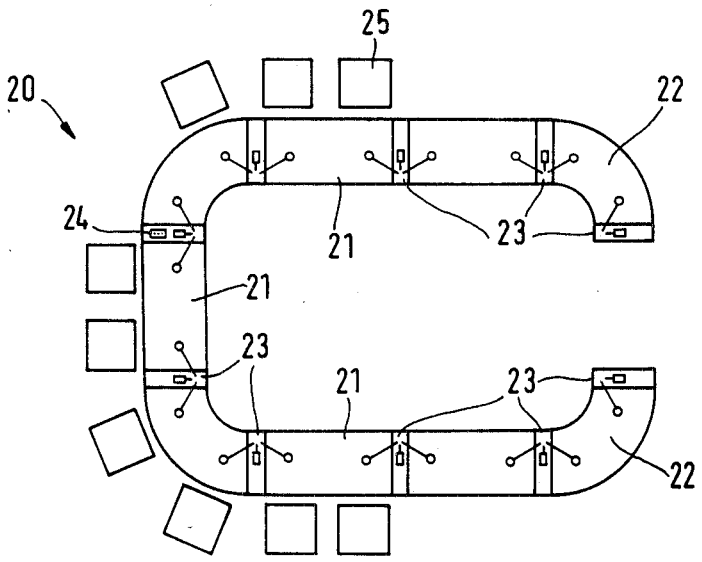
FIG. 1 is a schematic plan of a conference table arrangement with inserted accessory units.

The conference table arrangement according to FIG. 1 comprises rectangular conference tables 21 and, for example, rounded corner tables 22 and accessory units 23 as well as a control unit 24 inserted between two conference tables. At the ends of the C-shape arrangement two accessory units 23 are provided as terminations. Many other arrangements are possible.

FIGS. 2 to 7 show the arrangement of conference tables and accessory units on a larger scale. The conference table tops 26 are supported on frames 27 with C-shaped feet 28. They have seat postiion edges 29, opposite longitudinal edges 30 and short end edges 31. The conference table tops have a thickness D and an edge construction, not illustrated in more detail in these figures, with an edging of wood or plastic, in particular of a smooth soft integral plastic foam or the like.

Between end edges 31 of two conference tables an accessory unit 23 is provided. This has an add-on table top 32 and a foot 33, which corresponds to the foot 28 of the tables 21, 22 and supports the accessory unit 23. At the side of the conference table 21, 22 opposite the conference participant there is provided a column 35 extending up from the foot 28, as well as a screen 36. A screen 37 is also provided on the accessory unit 23.

The add-on table top 32 is like the conference table top in style and finish, thickness and the nature and arrangement of the edging but is, however, smaller. Both are, for example, 75 cm deep. While the conference table is, for example, 1.5 mm long, i.e. wide, the accessory unit has a width of about 20 cm.

The accessory table top 30 has an add-on table top 41 with an opening 42. This does not extend over the whole surface, but leaves a border portion with a width of about 2 to 5 cm on the side of the conference participant 34, while the opposite surface area 43 over the vertical column 35 for the fastening 39 of the foot 33 is larger.

In the opening 42 there is an upwardly opening trough 45 which is, for example, formed of sheet metal by welding parts together or by deep drawing. It can also be formed of plastic material and is then preferably metallized on the inner surface. It is secured at its sides to the table top for example, by screws. It has two compartments 46 and 47 which are separated from one another by a partition 48. Its side walls 49 have openings 72 for the cable 51. The compartment 47 is provided for intermediate voltage and contains a transformer 52 which supplies current to the light 53. The compartment 46 is for low voltage for the entire control device and the like.

The entire opening 42 is covered by a panel 55 which is secured in suitable manner, for example by clamping devices or screws, in the border of the opening.

As is illustrated in FIGS. 3, 7 and 8 to 11, the panel 55 has a control area 56 and an arm holder area 57. On the arm holder area 57 there are provided two goose neck lights 53 for illumination of the adjacent conference positions. Suitable switches (not shown) are provided. The conductor 52.1 for intermediate voltage, separated on grounds of EMC (electro-motice compatability) leads from a separate cable outlet 72 to a cable 51, which is also indicated only schematically in FIGS. 2 and 4 by a line. The arm holder area 57 further carries a single microphone holder 58 with a microphone 60 which is preferably combined in a structural unit with a separate loud speaker. This microphone has a spheroidal (kidney shaped) characteristic so that it can be used by both of the adjacent participants.

Figure 2:
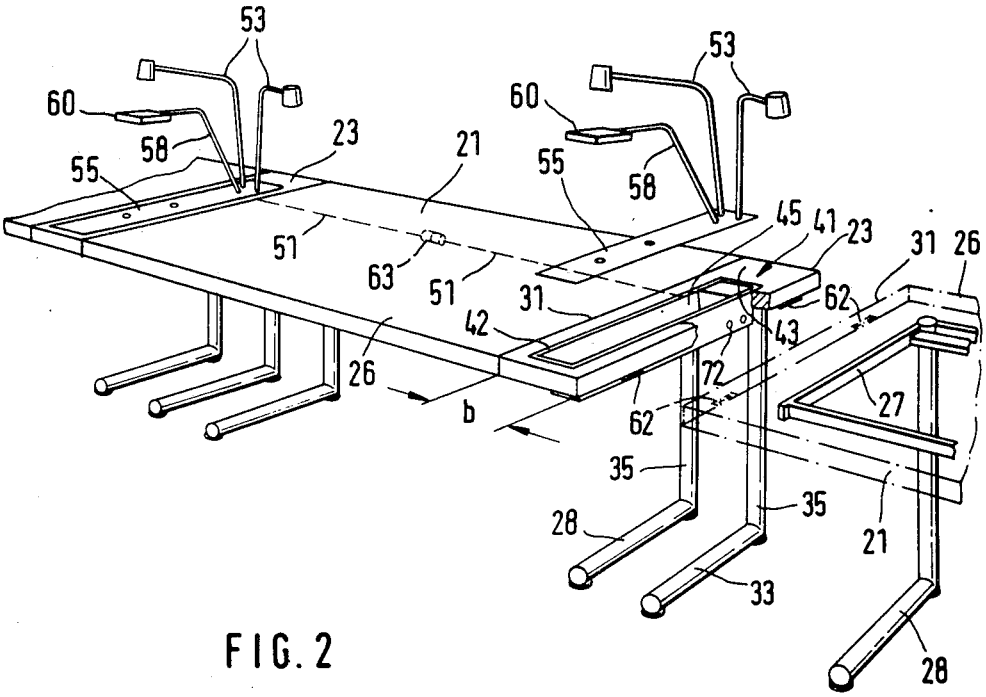
FIG. 2 is a schematic perspective view of conference tables with accessory units.

As can be seen from the drawings, the control area 56 is in convenient reach of the conference participants 34. Thus the entire table surface of the conference table 21, 22 remains free for writing materials. As will be seen, the electrical apparatus is orderly placed and arranged according to requirement. Quick release locks 62 between the conference table tops 26 and the accessory elements 23 with connecting loops or the like and if necessary aligning elements hold the conference table 21, 22 and the accessory unit 23 together and permit them to be easily separated. The conductors extending laterally out of the trough 45 are connected to cables 51 which have on their ends different plugs 63 for intermediate voltage and low voltage and controls which can be plugged in noninterchangeably. Their position and the length of the cable 51 are so chosen that they meet under the middle of the conference table 21 as can be seen in FIGS. 2 and 4. Suitable holding means such as adhesive clamps 65 under the conference table top 26, hold the cable 51 in the desired position and assure that the plugs 63 do not separate and that in view of the EMC, the necessary distance between the two parallel cables for intermediate voltage and low voltage is maintained. Instead of the adhesive clamps, easily opened cable canals can be provided under the conference table tops or along their longitudinal edges 30. The plugs can have screw or bayonet joints.

By virtue of the arrangement of the accessory unit there is provided a convenient and orderly arrangement of electrical apparatus for the conference tables which can otherwise be used as normal tables. The selected form with one accessory unit and one panel allows a very favorable construction and one which permits assembly as desired. As seen in FIG. 6, all of the electrical apparatus is mounted on the panel 55. The lights and the microphone have already been explained. As will be seen, the microphone is arranged above the compartment 46 because it is supplied with low voltage. Its holder and/or amplifier is designated by the reference numeral 70. It is connected by a schematically illustrated line 71 to the cable terminal 72. Moreover, there is illustrated a keyboard 73 on a mounting support 74. The mounting support 74 contains all necessary electronic parts and can be formed as a printed circuit or other panel which is mounted under the panel 55. A single line 75 to the cable terminal 72 indicates schematically the connection which naturally can be multiconductor.

Moreover, further electrical apparatus is illustrated schematically by the case 76. Above the panel 55 there is further shown schematically a control or contact element 77. A line 78 indicates the connection to the cable terminal 72. This symbolizes that different further devices such as switches, plug receptacles for headsets, selector switches for languages, adjustment devices for the amplitude of headsets and loudspeakers and the like can be suitably arranged. FIGS. 6 and 7 illustrate this only schematically. They indicate however, that all electrical apparatus switching and control elements are arranged and mounted on the panel 55. In further parts of the description and in the claims they will be designated as "E-apparatus." In this assembly of all E-apparatus on one panel and their splitting up into different areas depending on their functions, lies an essential element for a meaningful layout of conference tables with the necessary devices, which heretofore have been installed individually on the respective tables or offer an insufficient space for convenient housing. For further required splitting up and shielding of the different apparatusses from one another, additional partitions can be provided. FIG. 6 illustrates a further partition 80 which bounds a compartment 81. In this there is provided a supporting surface 82 on which there stands a removable ashtray 83 which extends through an opening 84 in the panel 55 and, for example, has a tiltable cover above the table surface. In like manner, drinking glasses or drinking flasks can be inserted in the opening 84.

Figure 8:
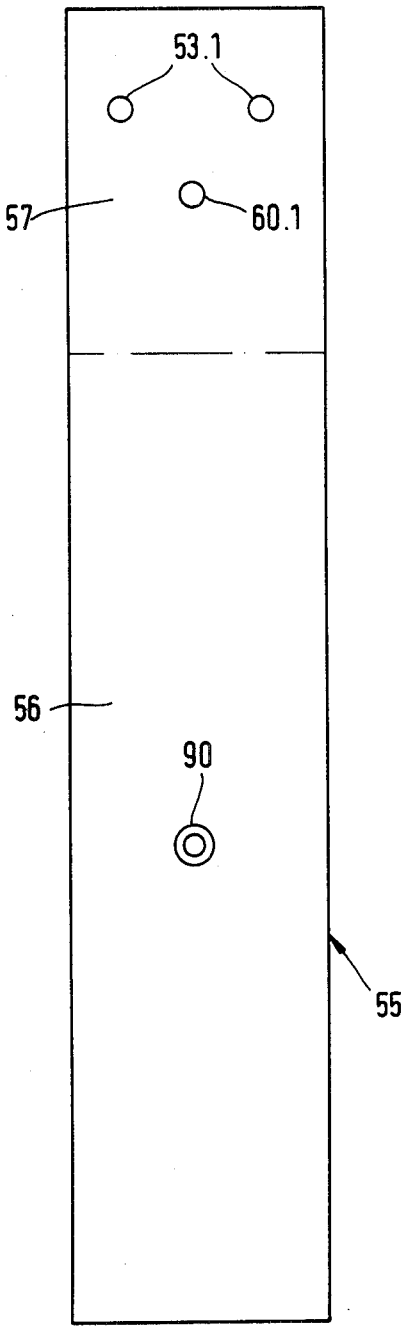
FIGS. 8 to 11 are schematic plans of different arrangements of panels.

FIGS. 8 to 11 show schematically, by way of example, different layouts of the panels. Attachment positions for the lights are designated at 53.1. The fastening position for the microphone is designated 60.1. These applicances are as a rule provided on all layouts. The layouts differ from one another mainly in the control element. The layout of FIG. 8 is for a simple discussion installation and has besides the usual components, only a switching and indicating element 90 with which the conference participant can transmit his speech. Upon speaking allocation, a light can go on. When a participant is speaking, a light on the microphone can illuminate or the like.

Figure 9:
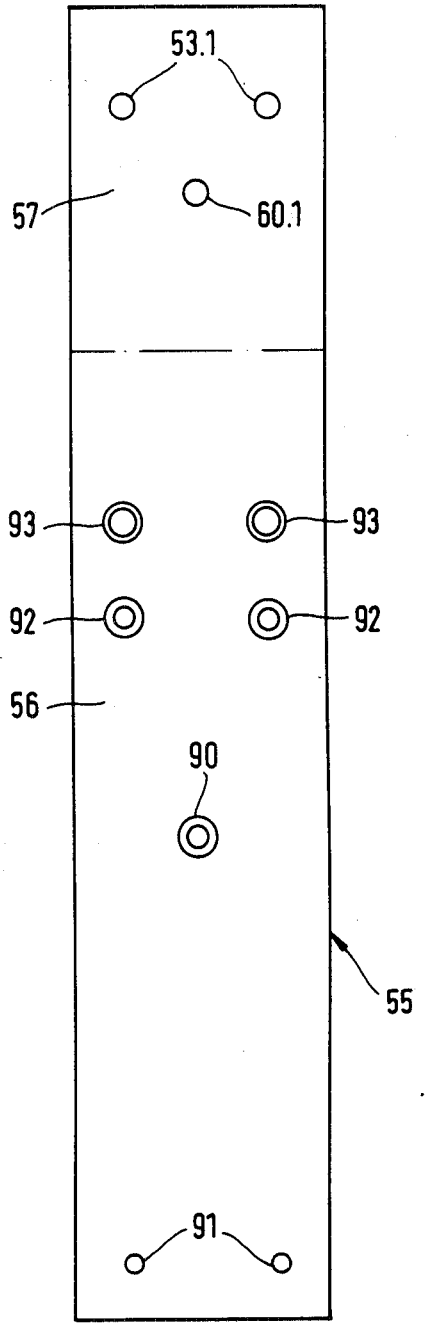

FIG. 9 further shows plug-in sockets 91 for two separate head sets and associated volume regulators 92 and if necessary, associated selector switches 93 for selecting the language in a simultaneous translation installation. These are preferably provided in duplicate so that each of two conference participants adjacent an accessory unit 23 is provided with separate elements while the microphone and switch 90 can be used in common.

Figure 10:
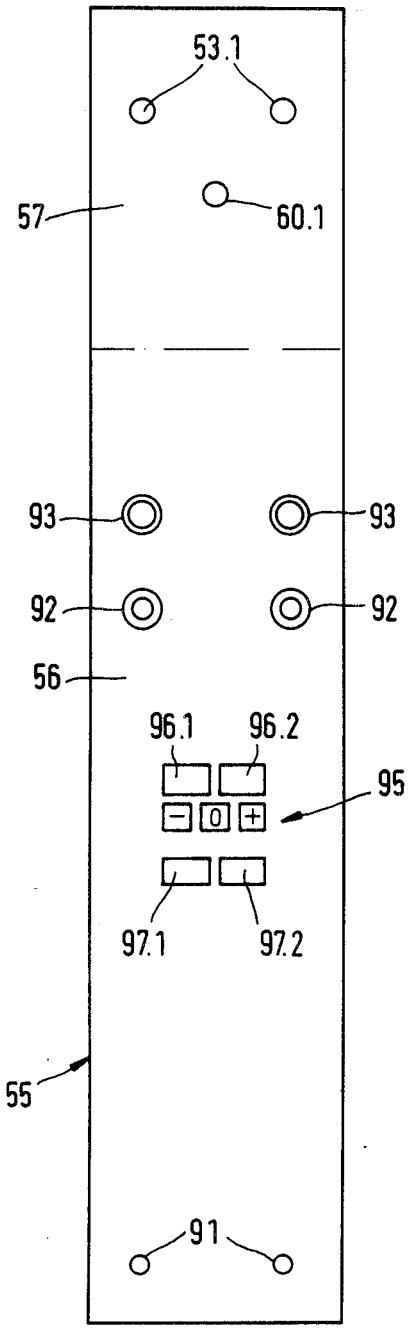

FIG. 10 shows the previously described elements but instead of the indicator switch 90 there is a keyboard 95. This keyboard 95 is here shown, by way of example for voting and is provided with the customary keys "−", "0" and "+" for voting "no", "abstaining" and "yes". So that the votes can be assigned to the proper participant, there are provided associated switches 96.1 and 96.2. These enable the conference chairperson to recognize which of the two participants has answered or given his vote. Moreover, there are provided two keys 97.1 and 97.2 which can be arranged as control keys and indicator instruments and, for example for switching the microphones for the announcement and the like if necessary with special electronic registration. Other switching elements can be arranged as desired.

Figure 11:
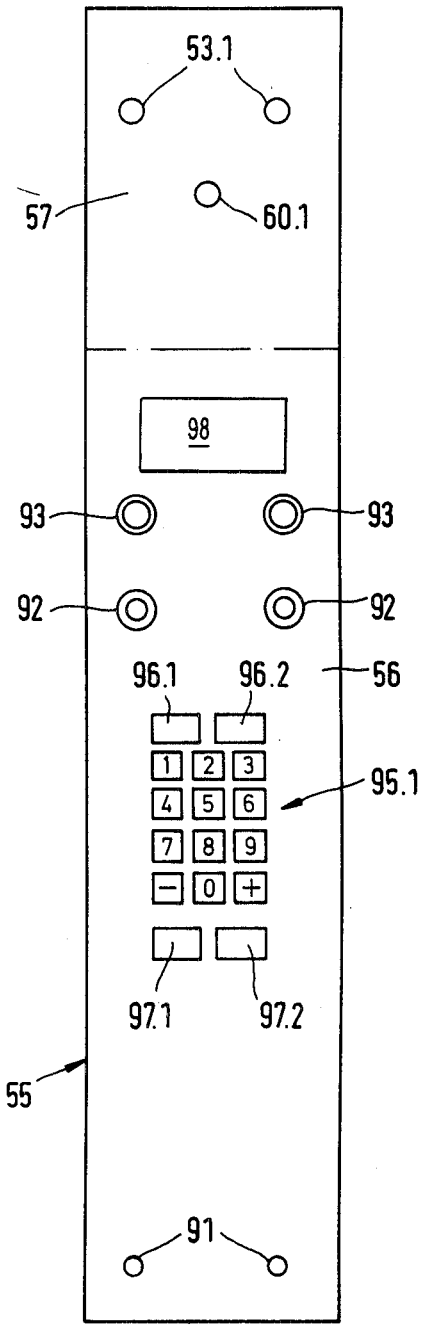

FIG. 11 shows a further example of the panel layout. In FIG. 11 like elements are designated by the same reference numerals as in FIGS. 8 to 10. Moreover, the keyboard 95.1 here has keys 0 to 9 with which one can enter a desired number. Thus the conference participant can receive numbers, can transmit number coded information and a manifold information exchange can be carried out between conference participants and the central station or also with one another. Moreover, there is also provided a viewing window or display screen 98 which can be designated "Display." Further there can be provided card readers for identification for example, with slits and electronic sensors under the panel. The conference participant can thereby be identified. Their messages can thereby or also over the described keyboard, be comprehended and their spoken messages recorded on tape. Also other electrical and electronic apparatus can be provided.

Figure 12:
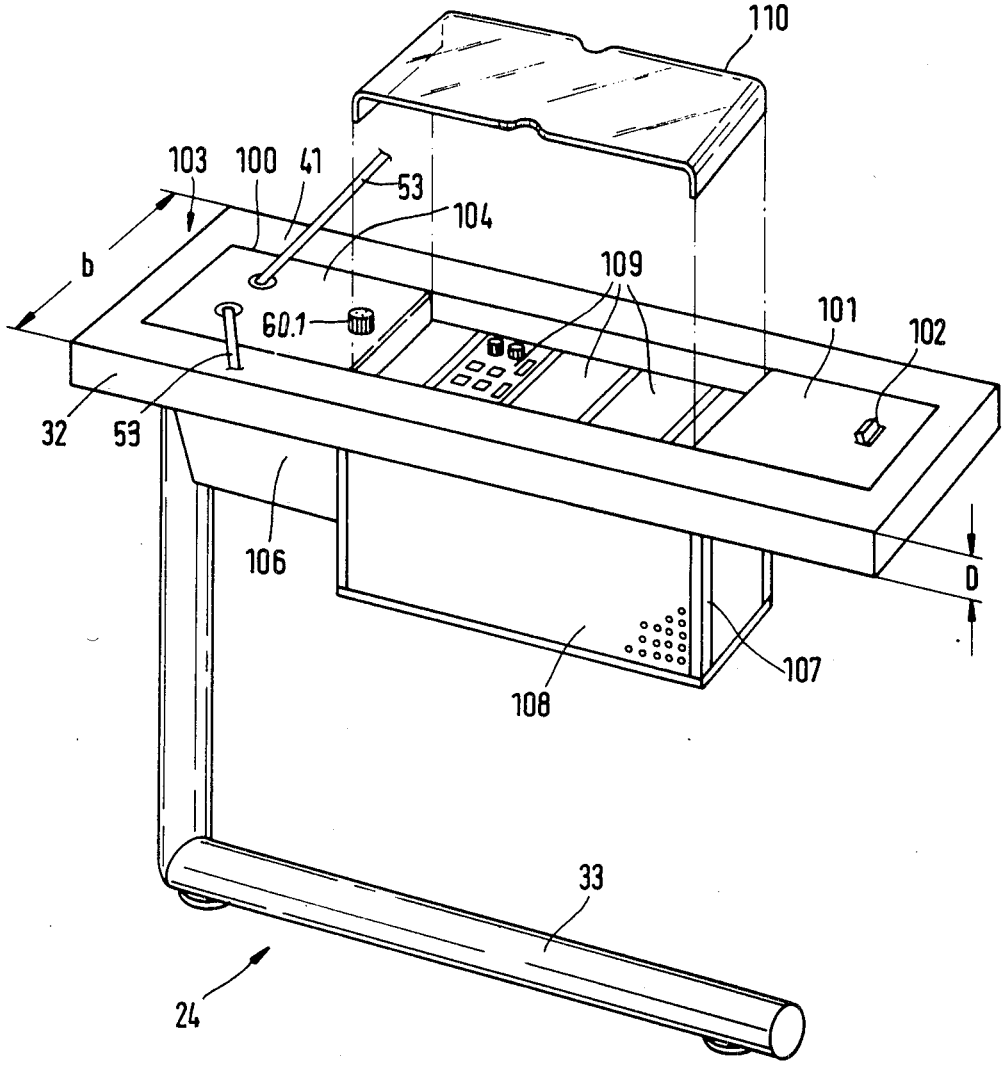
FIG. 12 is perspective view of a control unit.

The operational control unit 24 illustrated in FIG. 12, is installed in a like accessory table top 32 with a foot 33. The opening 100 is somewhat larger and is not provided with a unitary cover but rather a cover divided into three areas. At the right hand side of FIG. 12, there is seen a supporting plate 101 with a central switch 102 under which there is a small trough-form guard, although it can also be only a simple sheet metal plate. The left hand region 103 is provided with a divided panel 104 which is provided with two lights 53 and a microphone holder. Of the microphone holder, only the connector socket 60.1 is shown. A lower metal or metalized trough-like cover 106 closes the space underneath. The central region of the control unit 24 inside the opening 100, carries all required control operation, supply switching and amplifying elements. Thereto a standard frame 107 is provided with perforate covering walls 108 which enclose the modular elements and has on its upper side the different control panels 109 for the allocation and switching on of the microphones, for amplitude control and for voting evaluation and the like. A transparent molded cover 110 for example, of plexiglass, covers this region. Control units can also be formed with other devices and in other external form.

Instead of the construction with a table top with an opening, the trough 45 can be made as long as the table top up to the border and provided with corresponding holding devices. Then it can be suspended only laterally on the table top and provided with suitable fastening devices. Panels and accessories can be formed in like manner. The mounting of the foot has the great advantage that the entire unit can be mounted especially well in the right position and after removal can be stood next to one another in like manner. The foot can be made adjustable heightwise. Then the accessory table top can be positioned flush with conference tables of different heights. Although, for the most part, the E-apparatus is supplied by wire connections, individual elements such as call receivers or translation receivers can be supplied wireless.

In summary, the invention can also be described as follows:

The arrangement for holding, receiving, incorporating and connecting electrical apparatus on conference tables is formed as accessory unit 23 between two conference tables 21 or on an end and has a cover 55 for an accessory table top opening 42. On this cover 55 the electrical components are mounted and are convenient to the user. The accessory unit 23 can have a foot 33. Accessory components can be provided as required.

What we claim is:

1. In combination with a conference table having a top providing a writing surface for a user and opposite ends, an accessory unit disposed immediately adjacent one end of said conference table and comprising a top with a panel bearing electrical and electronic components including at least one microphone and receiving and transmitting communication apparatus, a space below said panel accommodating accessory elements for said components, means detachably supporting said accessory top approximately flush with said table top, and means for detachably electrically connecting said electrical and electronic components with electrical conductors extending lengthwise of said conference table.

2. A combination according to claim 1, in which said top of said accessory unit has an opening below which there is a trough-like casing providing said space for accommodating accessory elements, said panel constituting a removable cover for said opening.

3. A combination according to claim 2, in which said casing is metal and is connected to a neutral potential.

4. A combination according to claim 2, in which said casing is molded of plastic material and has a metalized coating connected to a neutral potential.

5. A combination according to claim 2, in which said casing is divided by at least one partition into a plurality of compartments which respectively house components operating at different potential levels.

6. A combination according to claim 1, in which said accessory unit has means for supporting said accessory top at the same height as said conference table.

7. A combination according to claim 6, in which said means for supporting said accessory top is adjustable to support said accessory top at different heights.

8. A combination according to claim 1, in which said accessory top has the same thickness of said conference table top and has an edge appearance matching the edge appearance of said conference table top.

9. A combination according to claim 1, in which said accessory top has the same depth as said conference table top but is of substantially less width.

10. A combination according to claim 1, further comprising quick-action fastening means for connecting said accessory top with said conference table top.

11. A combination according to claim 1, in which said panel is mounted substantially flush with said accessory top.

12. A combination according to claim 1, in which electrical components including said microphone are disposed on top of said panel and other components are mounted on the underside of said panel.

13. A combination according to claim 1, in which components on said panel include at least one reading lamp.

14. A combination according to claim 1, in which components on said panel include a keyboard.

15. A combination according to claim 1, in which components on said panel include a display screen.

16. A conference table assembly comprising a plurality of conference tables each having a top providing a writing surface for a user, and a plurality of accessory units sandwiched between adjacent conference tables, each of said accessory units comprising a top with a panel bearing electrical and electronic components including at least one microphone and receiving and transmitting communication apparatus, a space below said panel accommodating accessory elements for said components, means for removably supporting said accessory top approximately flush with table tops of adjacent conference tables and means for detachably electrically connecting said electrical and electronic components with electrical conductors extending lengthwise of said conference tables.

17. A conference table assembly according to claim 16, in which said accessory units are electrically connected with one another by multiconductor electrical cables extending longitudinally of said conference tables and provided with quick-action couplings for connecting components of said accessory units with said cables.

18. A conference table assembly according to claim 17, in which said quick-action couplings comprise non-interchangeable contact means to assure proper connection of respective conductors to components of said accessory units.

19. A conference table assembly according to claim 16, in which said conference tables are of a length to accommodate two users and in which said accessory units provide facilities for two adjacent users, one at each of the two adjacent conference tables.

20. A conference table assembly according to claim 19, in which each said accessory unit has certain components duplicated and certain components including said microphone for use in common by said adjacent users.

21. A conference table assembly according to claim 16, further including a master accessory unit adjacent a conference table for a chairperson, said master accessory unit being similar to the aforesaid accessory units but having different electrical components.

* * * * *